US007235118B2

(12) United States Patent
Bouaricha et al.

(10) Patent No.: US 7,235,118 B2
(45) Date of Patent: Jun. 26, 2007

(54) PROCESS FOR AGGLOMERATION AND DENSIFICATION OF NANOMETER SIZED PARTICLES

(75) Inventors: Salim Bouaricha, Longueuil (CA); Jean-Gabriel Legoux, Boucherville (CA)

(73) Assignee: National Research Council of Canada, Ottawa, Ontario (CA)

( * ) Notice: Subject to any disclaimer, the term of this patent is extended or adjusted under 35 U.S.C. 154(b) by 289 days.

(21) Appl. No.: 10/414,316

(22) Filed: Apr. 16, 2003

(65) Prior Publication Data

US 2004/0208775 A1 Oct. 21, 2004

(51) Int. Cl.
*B22F 9/04* (2006.01)

(52) U.S. Cl. ..... 75/354; 148/513

(58) Field of Classification Search ..... 148/513
See application file for complete search history.

(56) References Cited

U.S. PATENT DOCUMENTS

| | | | | |
|---|---|---|---|---|
| 3,591,362 | A | 7/1971 | Benjamin | 75/0.5 BA |
| 3,660,049 | A | 5/1972 | Benjamin | 29/182.5 |
| 3,723,092 | A | 3/1973 | Benjamin | 75/0.5 R |
| 3,728,088 | A | 4/1973 | Benjamin | 29/182.5 |
| 3,737,300 | A | 6/1973 | Cairns et al. | 75/0.5 BC |
| 3,738,817 | A | 6/1973 | Benjamin | 29/182.5 |
| 3,740,210 | A | 6/1973 | Bomford et al. | 75/0.5 BC |
| 3,746,581 | A | 7/1973 | Cairns et al. | 48/11.5 F |
| 3,749,612 | A | 7/1973 | Benjamin et al. | 148/11.5 F |
| 3,785,801 | A | 1/1974 | Benjamin | 75/0.5 BC |
| 3,809,549 | A | 5/1974 | Opratko et al. | 75/101 R |
| 3,814,635 | A | 6/1974 | Cometto et al. | 148/11.5 R |
| 3,816,080 | A | 6/1974 | Bomford et al. | 29/182.5 |
| 3,830,435 | A | 8/1974 | Hill | 241/27 |
| 3,844,847 | A | 10/1974 | Bomford et al. | 148/11.5 F |
| 3,865,572 | A | 2/1975 | Fisher et al. | 75/0.5 R |
| 3,877,930 | A | 4/1975 | Volin | 75/0.5 R |
| 3,912,552 | A | 10/1975 | Schultz et al. | 148/31 |
| 3,926,568 | A | 12/1975 | Benjamin et al. | 29/182.5 |
| 4,134,852 | A | 1/1979 | Volin | 252/472 |
| 4,749,545 | A | 6/1988 | Begg et al. | 419/13 |
| 4,787,561 | A | 11/1988 | Kemp, Jr. et al. | |
| 4,818,567 | A | 4/1989 | Kemp, Jr. et al. | |
| 5,338,374 | A * | 8/1994 | Marcus et al. | 148/237 |
| 5,631,044 | A | 5/1997 | Rangaswamy et al. | |
| 5,939,146 | A * | 8/1999 | Lavernia | 427/446 |
| 6,156,428 | A * | 12/2000 | Gibson | 428/402 |
| 6,420,043 | B1 * | 7/2002 | Fife et al. | 428/472 |
| 6,832,735 | B2 * | 12/2004 | Yadav et al. | 241/16 |
| 6,855,426 | B2 * | 2/2005 | Yadav | 428/403 |
| 6,899,948 | B2 * | 5/2005 | Zhang et al. | 428/331 |
| 6,902,699 | B2 * | 6/2005 | Fritzemeier et al. | 419/38 |

* cited by examiner

*Primary Examiner*—George Wyszomierski
(74) *Attorney, Agent, or Firm*—Paul S. Sharpe; Ogilvy Renault LLP

(57) ABSTRACT

A method and product derived therefrom for consolidating nanoparticles to form particles in a micrometric size distribution. The method preserves the nanoparticles with the resultant micrometric particles. The primary processing operation is milling.

6 Claims, 13 Drawing Sheets

1.00 mm

100 μm 2809 20KV X350 100 μm WD28

2933 20KV X350 100 μm WD11

PROCESS FOR AGGLOMERATION AND DENSIFICATION OF NANOMETER SIZED PARTICLES

FIELD OF THE INVENTION

The present invention relates to the agglomeration and densification of nanoparticles powders or particles of nanometric scale sizes that can be produced by any kind of technique. More particularly, the present invention relates to densification of nanoparticles into micrometric particles.

BACKGROUND OF THE INVENTION

It is well known, since its development by Benjamin et al. in U.S. Pat. No. 3,591,362, that the basic mechanism of mechanical milling, alloying or grinding, consists of a repeated deformation, fracture and cold welding by high energetic ball collisions. Depending on the dominant process during milling, such as fracturing, welding or microforging, a particle may become smaller through fracturing or may grow through agglomeration. This process has been extensively used for particle size reduction or growth, shape change, solid-state alloying or blending, modifying, changing or altering properties of material like the density or flowability, mixing or blending of two or more materials and agglomeration. The following patents are examples of issued patents which disclose methods of producing mechanically alloyed composite powders and consolidated products: U.S. Pat. Nos. 3,591,362; 3,660,049; 3,723,092; 3,728,088; 3,738,817; 3,740,210; 3,785,801; 3,809,549; 3,737,300; 3,746,581; 3,749,612; 3,816,080; 3,844,847; 3,865,572; 3,814,635; 3,830,435; 3,877,930; 3,912,552; 3,926,568; and 4,134,852.

Ball-milling has also been used to produce nanocrystalline materials with a structure having a large number of grains and grain boundaries, within particles globally in the micrometer scale size. In the literature, there are a large number of scientific papers attesting the capability of this technique to do so. Nanostructured materials can also be obtained by methods that do not involve ball-milling. These methods include DC and RF plasma processes, vapor-phase reactions, sol-gel techniques, combustion, emulsion and laser or hydrothermal synthesis. All these techniques produce mainly nanostructured materials with nanometer sized particles, bonded together by Van der Waal's electrostatic forces (a soft agglomeration) and present a very low density.

One of the primary limitations with nanoparticles is that nanoscale particles cannot be processed directly in many applications such as thermal spraying because of the extremely low density and flowability. Thus, there is a vital need for densifying and consolidating by agglomeration such particles into micrometer scale to enable processing. Usually, agglomeration of powders is achieved via spray drying, fluid bed agglomeration, or granulation. As a drawback, these processes often require an organic binder to ensure particle adherence, which may remain after agglomeration. There is also a risk for powder to react with the agglomeration media to form undesirable species such as oxides.

Ball milling has been used to produce powders for different applications. However, it is believed that the use of ball milling to agglomerate nano-sized particles into micrometric-sized particles has not been previously proposed. This is also believed for association of two different techniques, namely, production of nanostructured powders of a nanoscale particle size, and agglomeration of the nanoscale powders into nanostructured micrometric powders with a relatively high density.

In U.S. Pat. No. 5,631,044, issued to Rangaswamy et al., there is disclosed an improved method utilizing a high energy ball mill for preparing binder-free clad powders. The powders are indicated to be useful as thermal spray powders. It is stated that the binder-free clad powders have a core material with a particle size range of about 10 to 200 microns. These are coated or partially coated with a second material, significantly smaller than the particle size of the core material with a particle size ranging from 0.1 to 20 microns. At least one of the two materials must be deformable within the high energy ball mill. The processing time is less than about one hour. The result is a thermal spray powder having an average particle size from about 10 to 150 microns.

In U.S. Pat. No. 4,749,545, issued to Begg et al., a method is discussed which allows preparation by ball milling of composite particles made of hard material such as SiC and a matrix of aluminum or magnesium. The former material has a particle size less than 50 microns while the second is less than 100 microns. The method enables mixing of a high proportion of hard materials to be incorporated into the composite.

Similar to the previous patent, in U.S. Pat. No. 4,818,567, issued to Kemp, Jr. et al., metallic coated particles are disclosed. The particles have a core consisting essentially of metals, metal alloys, ceramics, ceramic glasses, and a coating relatively uniformly distributed on the core. The coating comprises a relatively ductile and/or malleable metallic material selected from metals and metal alloys.

In U.S. Pat. No. 4,787,561, issued to Kemp, Jr. et al., a process involving the grinding of particles of a ductile and/or malleable material which may be metal, metal alloy, or metal-ceramic composites, with a combination of parameters and environment in a ball attritor mill was disclosed. The product is densely packed particles, having a substantially granular appearance and an aspect ratio of from greater than 1 to about 50 and a mean particle size of less than about 20 micrometers in diameter.

All the above-mentioned patents have used ball milling as a tool to coat a core material or to prepare composite materials that have a microcrystalline structure. None of these reports the use of ball milling to agglomerate and consolidate nanoparticle powders.

SUMMARY OF THE INVENTION

One object of the present invention is to provide an improved process for consolidation of nanoparticle powders.

A further object of one embodiment of the present invention to provide a method of increasing the density of nanoparticles, comprising the steps of:

providing particles of a nanometer size; and milling said particles with milling means to consolidate particles into agglomerated particles in a micrometric size distribution in the absence of binder material.

Proposed is a technique involving binderless ball-milling of nanoparticles for a short time in air or a controlled atmosphere. The resultant powders are agglomerated into particles having a size distribution, ranging from about 1 μm to more than about 100 μm, thus enabling manipulation by standard powder handling techniques. Further, the produced micrometric particles are consolidated with a high level of densification, and hence, do not need post processing like cold compaction and sintering. Importantly, the process preserves the nanostructure crystalline nature of the agglomerated particles; grains in the consolidated product remaining within the nagnometric size scale.

The process agglomerates and consolidates without binder and with a high density, nanostructured powders that have particles in the nanometer size, produced originally by any kind of technique. The process involves milling the nanoparticles by ball milling for a short period of time. The produced nanosized particles are agglomerated into powders having a micrometric particle size distribution. The starting nanostructure particles could be composed of a ductile material or composite made from ductile and brittle materials.

A further object of one embodiment of the present invention is to provide an agglomerated particle, comprising:

a particle of a micrometric size distribution formed of compacted nanoparticles of a nanometric size distribution where said particle of micrometric size distribution includes discrete nanoparticles.

This invention allows agglomeration of nanoparticles into micrometric particles. This conditioning is very useful to convert the particles for applications like thermal spraying or any other application requiring good flowability. This is also effective for avoiding manipulation of fine particle powders that are otherwise very reactive due to their high surface area. Conveniently, the process does not increase the grain size of the agglomerated particles.

Having thus described the invention, reference will now be made to the accompanying drawings.

BRIEF DESCRIPTION OF THE DRAWINGS

Similar numerals employed in the specification denote similar elements.

DETAILED DESCRIPTION OF THE PREFERRED EMBODIMENT

Powder Preparation by Ball-Milling

Figure 1A:
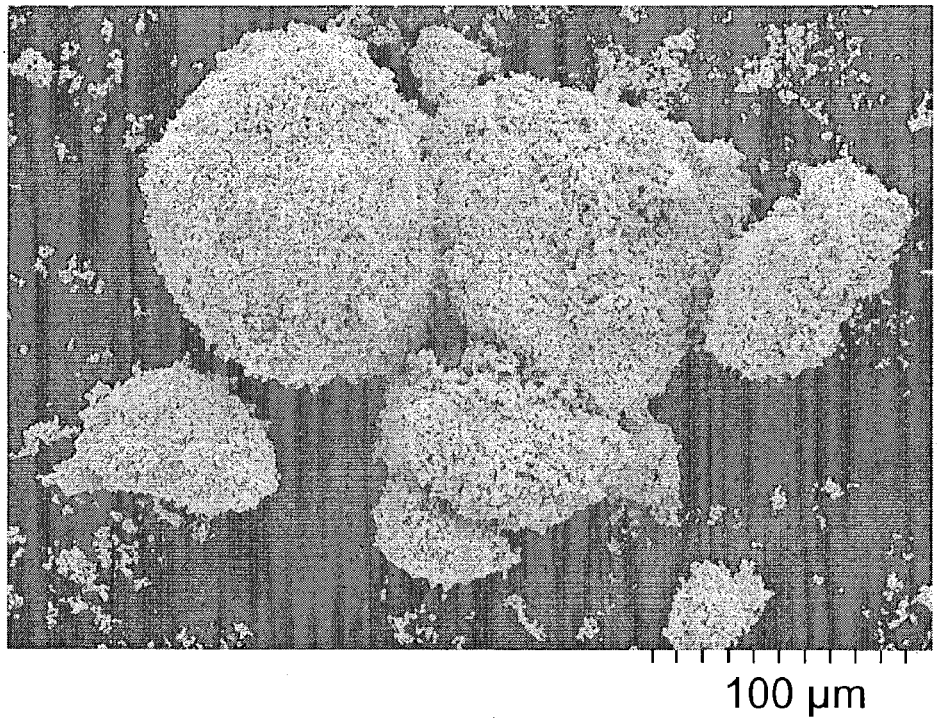
FIGS. 1*a*) and 1*b*) are enlarged scanning electron microscope images (350× and 20000×, respectively), illustrating the morphologies of the copper powder, material 1 as described in Table 1.

Three powders were used in the study as starting materials: a copper powder with a nanometer size distribution from CEPC (Canadian Electronic Powders Corporation), a NanoCarb WC-12Co (88% WC and 12% Co by weight) from NanoCarb, and a WC (<1 μm) from Cerac Inc. These powders are referred as material 1, 2 and 3, respectively, as described in Table 1.

TABLE 1

Material Description

| Material | Description |
|---|---|
| 1 | Copper from CEPC (Canadian Electronic Powders Corporation). Particles size are between 50 nm and 1 μm. |
| 2 | Tungsten carbide (WC) from cerac inc. Particles size are lower than 1 μm |
| 3 | Nanocrystalline cermet powder (WC-12et. % Co) from NanoCarb. |
| 4 | Material 1, ball-milled for a half hour (0.5 h) under nitrogetn (N2) atmosphere |
| 5 | Material 1, ball-milled for one hour (0.5 h) under nitrogetn (N2) atmosphere |
| 6 | Material 1, ball-milled for a half hour (0.5 h) under air atmosphere |
| 7 | Material 1, ball-milled for one hour (1 h) under air atmosphere |
| 8 | Admixture of Materials 1 and 2, ball-milled for one hour (1 h) under Nitrogen (N2) atmosphere. The composition was 90% WC—10% Cu. |
| 9 | Material 3, ball-milled for 1 hour under air atmosphere. |

From starting powders 1 to 3, six new powder materials were generated by using ball milling. These powders are also described in detail in Table 1.

Ball milling was made with a Spex 8000 machine, using stainless steel vial and grinding balls. The ball to powder weight ratio was 10:1 and the amount of the total weight of the powder was 3 g for each milling operation. Depending on produced materials, the handling of the samples was done in a nitrogen atmosphere in a glove box or in air.

Powder Characterization

Scanning electron microscopy (SEM) micrographs were obtained with a Hitachi™ H-4700 electron microscope. The microscope was also operated in the backscattered electron mode.

X-ray diffraction measurements were carried out using a Bruker™—AXS diffractometer with Cu-$K_\alpha$ radiation. The average crystallite size was calculated from the full width at half maximum of the reflection peaks using a Williamson-Hall style plot [G. K. Williamson and W. H. Hall, Acta Metall. 1 (1953) 22].

EXAMPLE 1a

Agglomeration and Consolidation of Metallic Materials by Ball Milling Under $N_2$ Atmosphere According to the invention, Table 1 sets forth the description of six materials (materials 4 to 9) fabricated from the three starting original materials (materials 1 to 3).

Figure 1B:
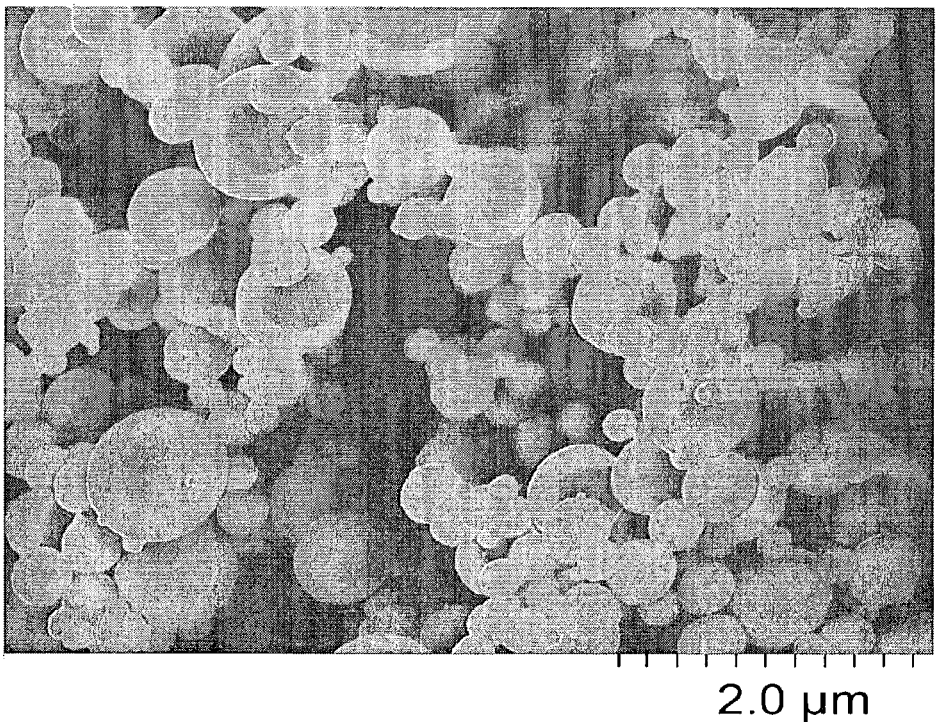

FIGS. 1*a* and 1*b* show images obtained by SEM of the starting original copper powders. The particle has a wide particle size distribution from about 50 nm to less than about 1 micrometer. This powder, as FIG. 1*b* illustrates, is mostly agglomerated in clusters of about 100 micrometers. This kind of agglomeration is very weak and can be easily dispersed by handling and therefore, there is a need for agglomeration with stronger bonds.

Figure 2A:
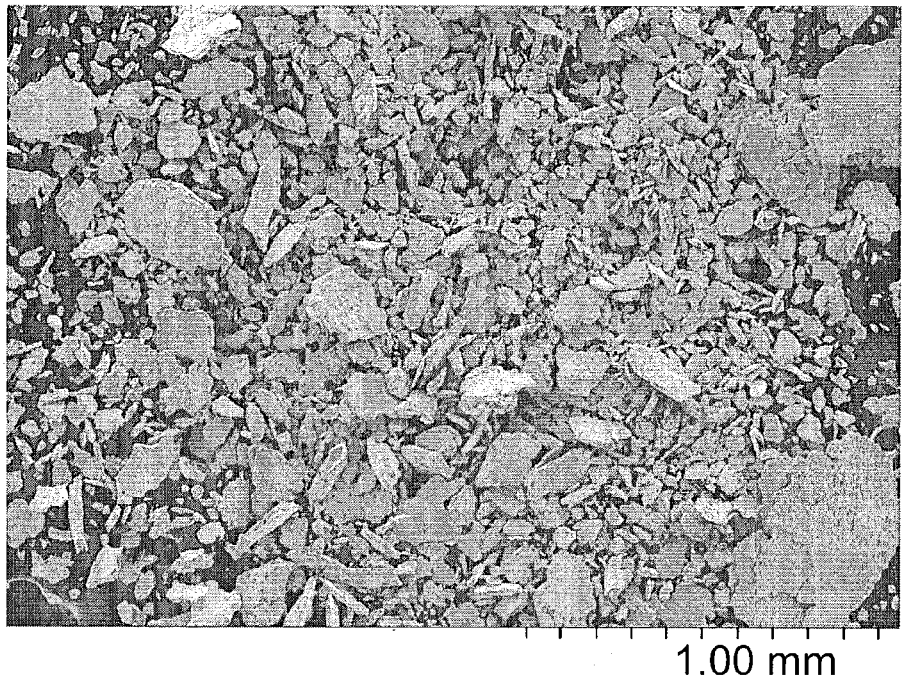
FIGS. 2*a*) and 2*b*) are enlarged scanning electron microscope images (50× and 350×, respectively) of the powder for material 4, described in Table 1.
Figure 2B:
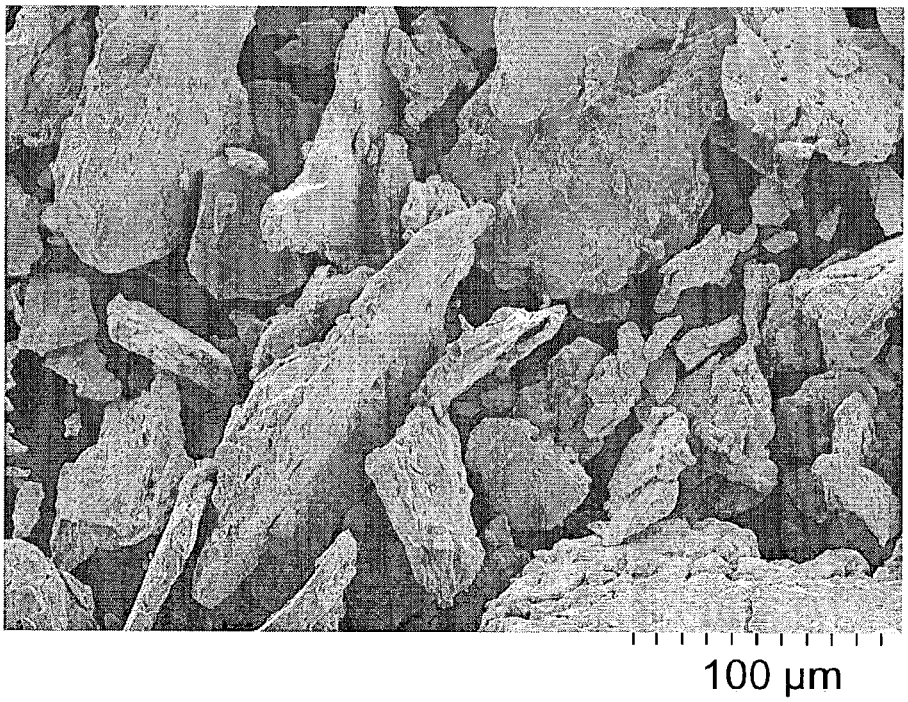

FIGS. 2*a* and 2*b* are SEM identifying the morphology of material 4, which was produced after a half hour of ball milling in nitrogen atmosphere. The powder of this material has a flaky shape with a wide particle size distribution from about 10 μm to more than about 100 μm.

Figure 3A:
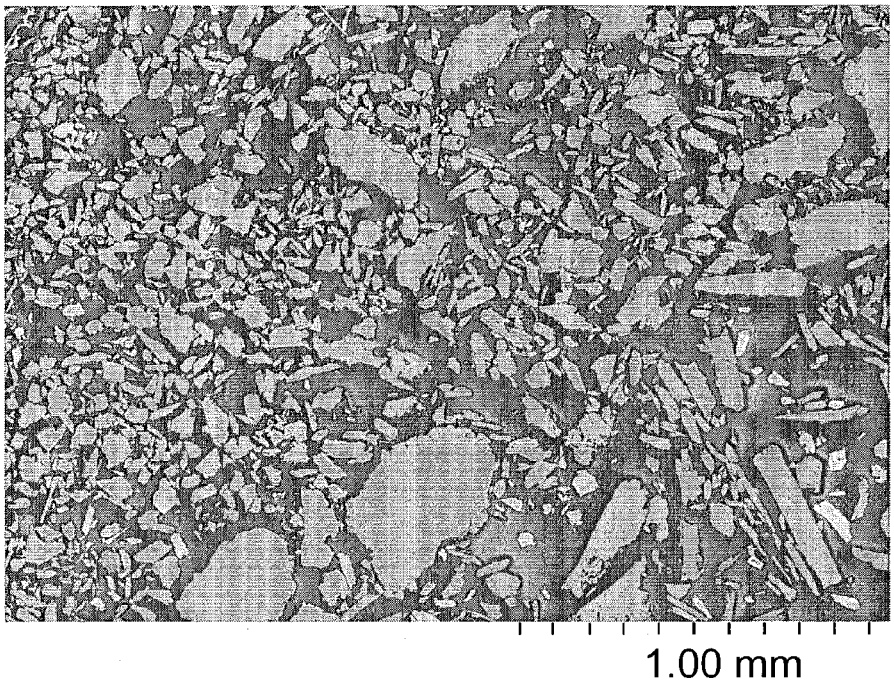
FIGS. 3*a*) and 3*b*) are scanning electron microscope cross-section images of powder for material 4, as presented in FIGS. 2*a*) and 2*b*), respectively.
Figure 3B:
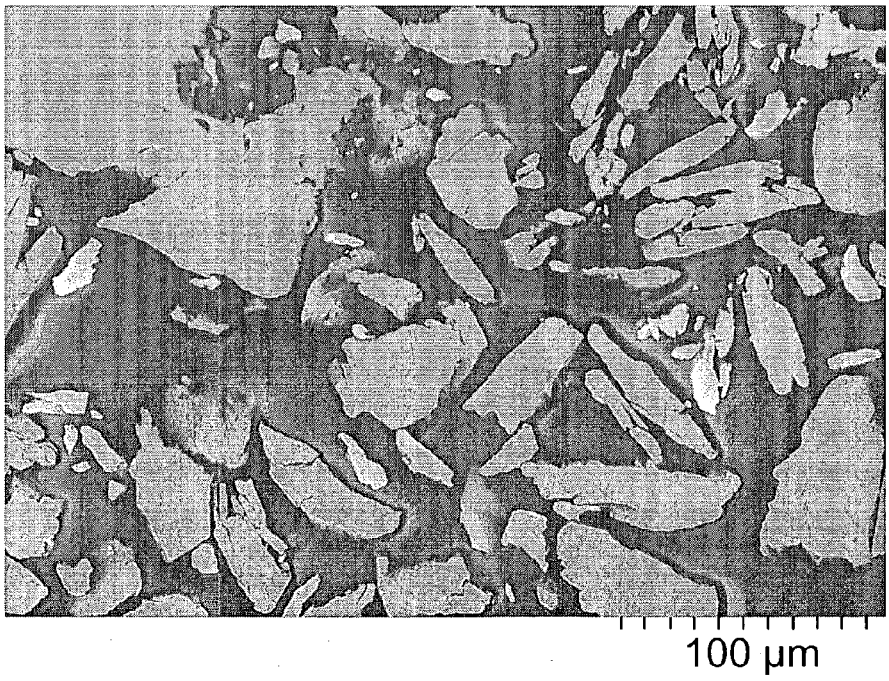
Figure 4A:
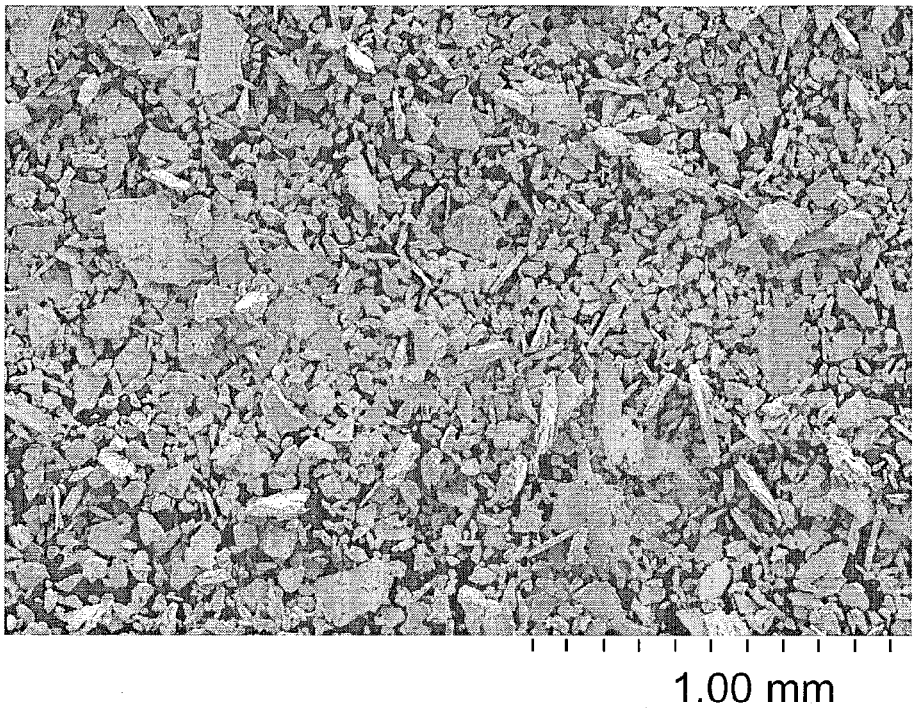
FIGS. 4*a*) and 4*b*) are enlarged scanning electron microscope images (50× and 350×, respectively) of the powder for material 5, described in Table 1.
Figure 4B:
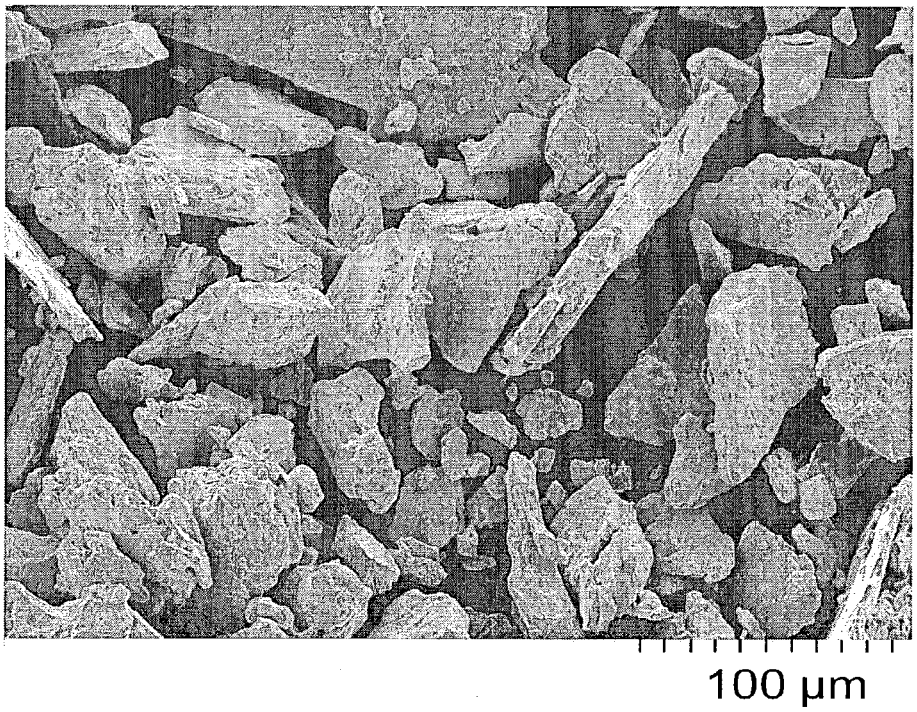
Figure 5A:
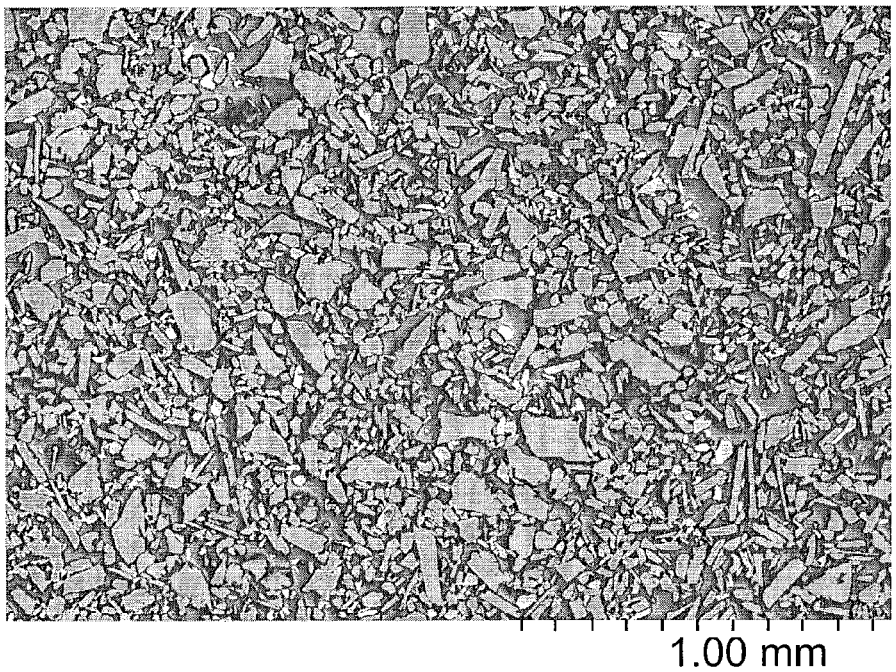
FIGS. 5*a*) and 5*b*) are scanning electron microscope cross-section images of powder for material 5, as presented in FIGS. 4*a*) and 4*b*), respectively.
Figure 5B:
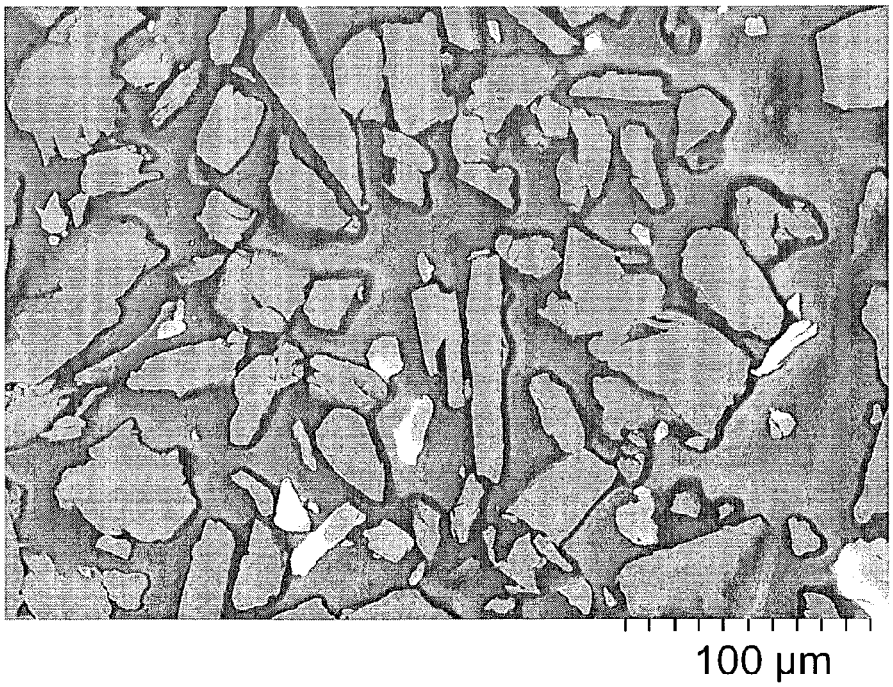

FIGS. 3*a* and 3*b* are SEM cross sections of the particles described in FIG. 2*a* and 2*b*, respectively. The SEMs demonstrate the high density of the particles. FIGS. 4*a* and 4*b* show the morphology of material 5, which, contrary to material 4, was ball milled in a nitrogen atmosphere for a longer period of time, i.e. 1 *h*. Its particle size distribution is tighter since the difference between largest and smallest particles is smaller for material 5 than for material 4. Further, similar to powders produced after a half hour milling, the powder for material 5, as shown in FIGS. 5*a* and 5*b*, is also consolidated in particles with a high level of density.

From this data, it has been shown that agglomeration and consolidation of the nano-sized particles into particles of micrometric size with a high level of density is achievable.

EXAMPLE 1b

Figure 6A:
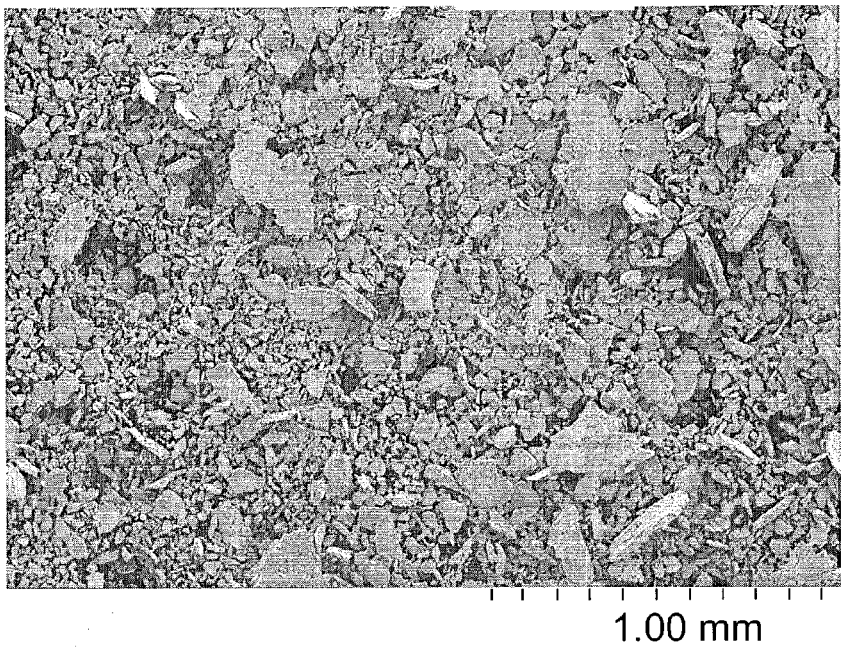
FIGS. 6*a*) and 6*b*) are enlarged scanning electron microscope images (50× and 350×, respectively) of the powder for material 6, described in Table 1.
Figure 6B:
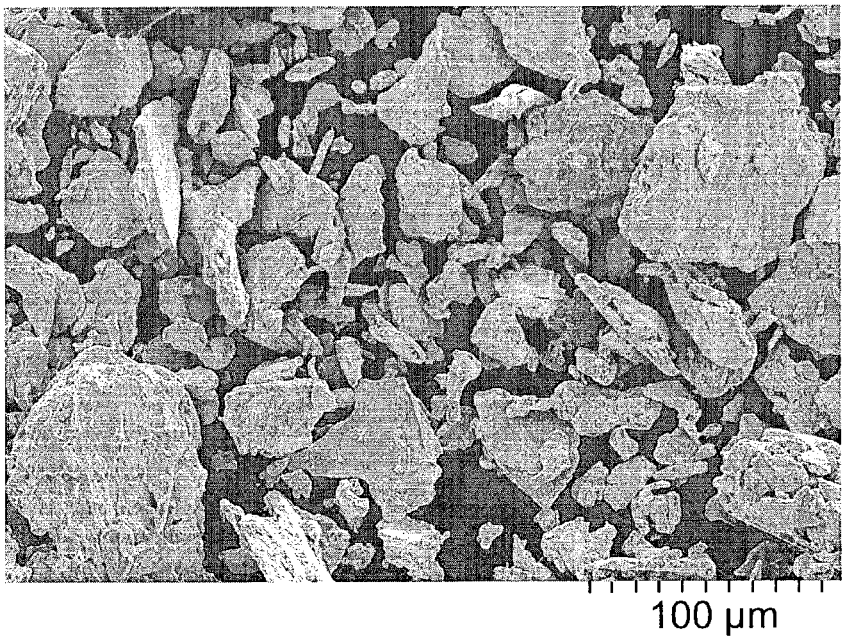

Agglomeration and Consolidation of Metallic Materials by Ball Milling Under Reactive Atmosphere Like Air FIGS. 6*a* and 6*b* are SEMs of the morphology of material 6, which was produced after a half hour of ball milling in air atmosphere. The powder of this material has a flaky shape with a wide particle size distribution from about 10 μm to more than about 100 μm.

Figure 7A:
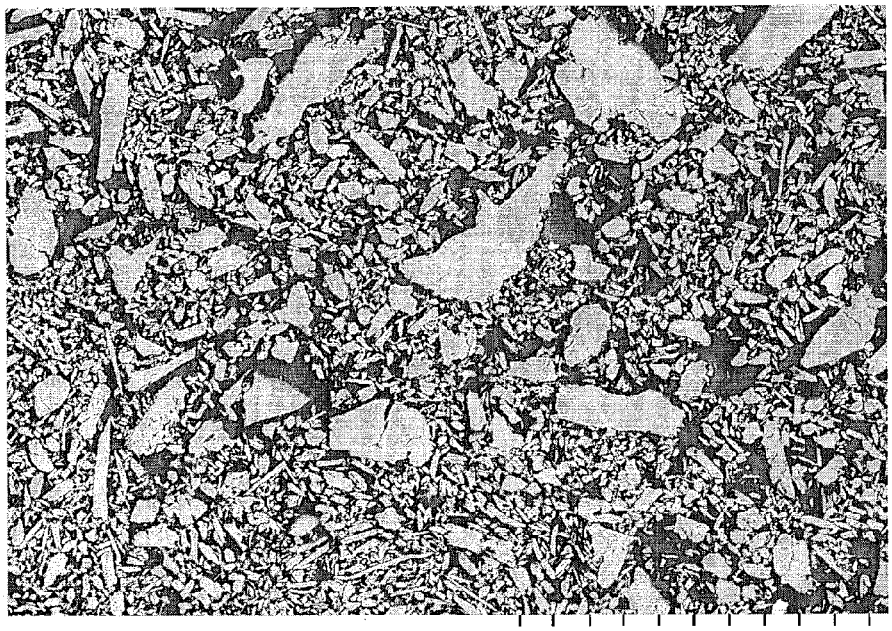
FIGS. 7*a*) and 7*b*) are scanning electron microscope cross-section images of powder for material 6, as presented in FIGS. 6*a*) and 6*b*), respectively.
Figure 7B:
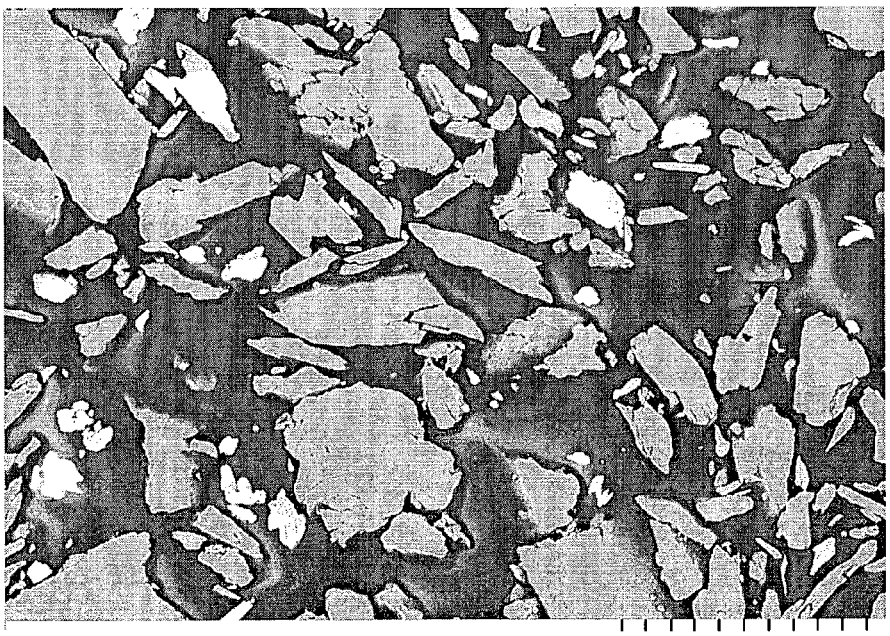

FIGS. 7*a* and 7*b* are SEM cross sections of powders, as previously shown in FIGS. 6*a* and 6*b*, respectively. It demonstrates clearly the high density of the produced particles.

Figure 8A:
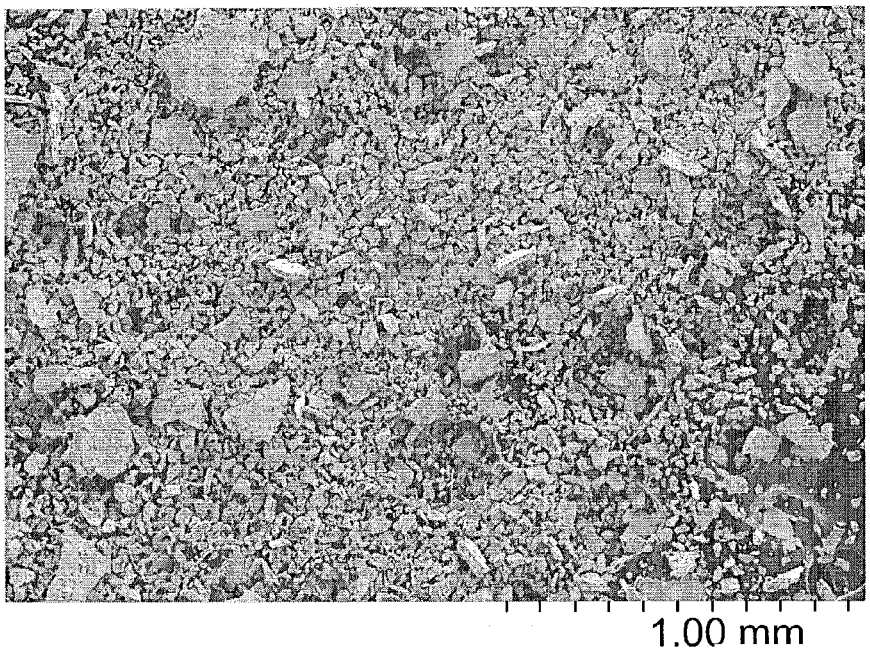
FIGS. 8*a*) and 8*b*) are enlarged scanning electron microscope images (50× and 350×, respectively) of the powder for material 7, described in Table 1.
Figure 8B:
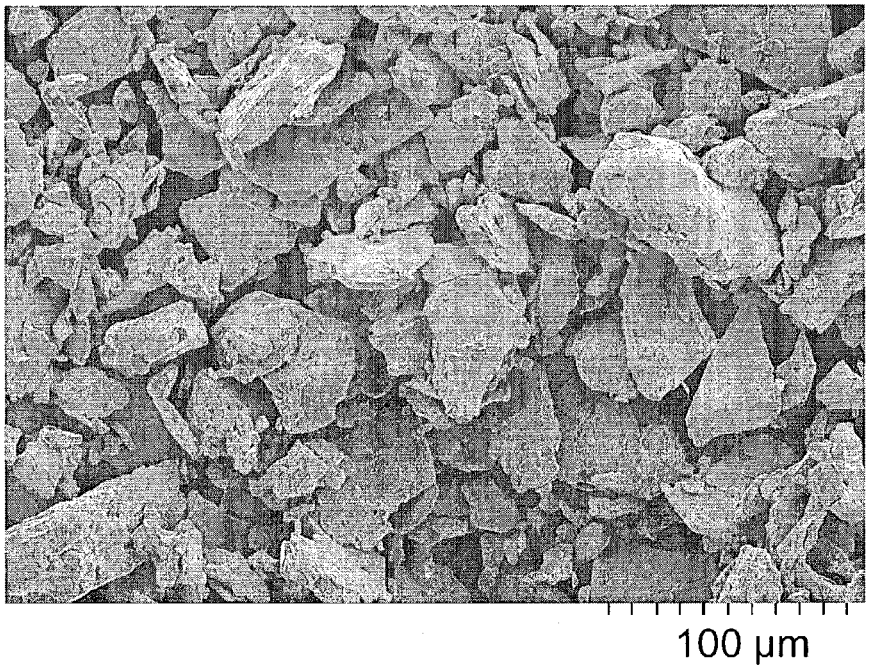
Figure 9A:
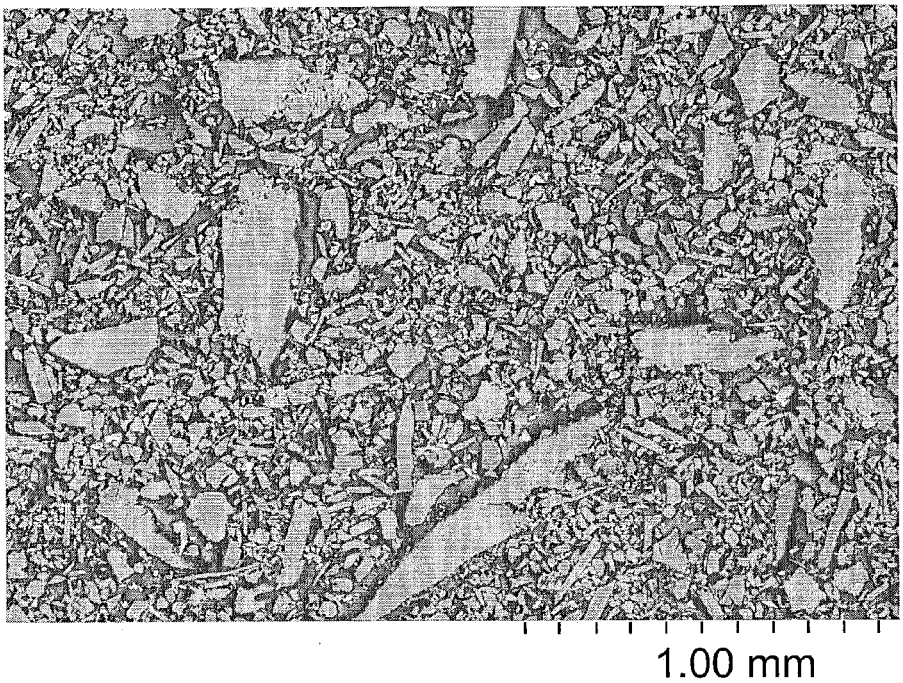
FIGS. 9*a*) and 9*b*) are scanning electron microscope cross-section images of powder for material 7, as presented in FIGS. 8*a*) and 8*b*), respectively.
Figure 9B:
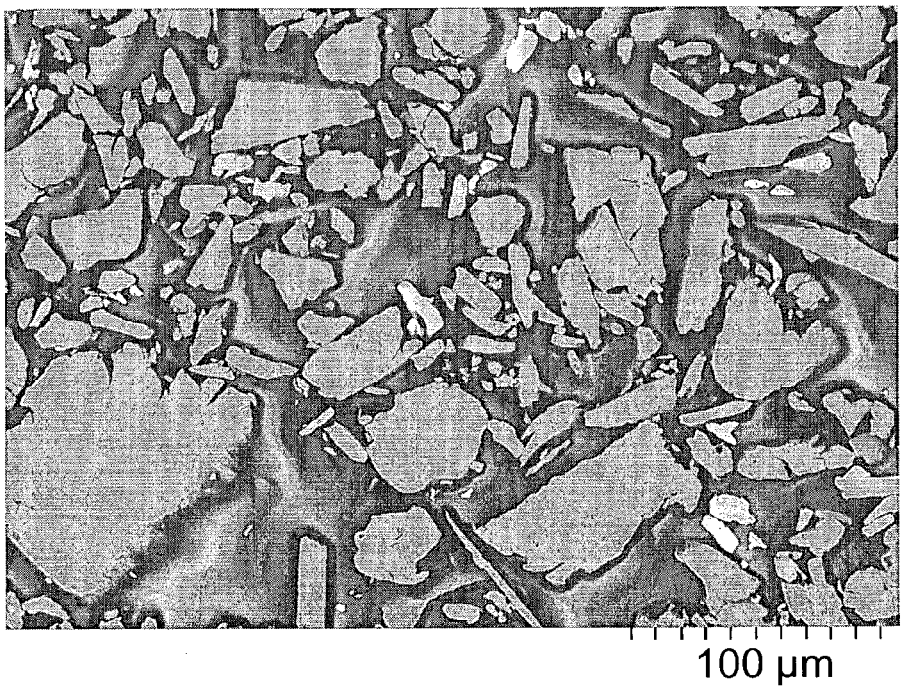

FIGS. 8*a* and 8*b* are SEM depicting morphology of material 7, which, contrary to material 6, was ball milled in air for a longer period of time, i.e. 1 h. Its particle size distribution is narrower since the difference between largest and smallest particles is smaller for material 6 than for material 7. Similar to powders of a half hour of milling, the powder in material 5, as shown in FIGS. 9*a* and 9*b*, is also consolidated into particles with a high level of density.

In comparison to Example 1*a*, when milling is performed in an atmosphere containing sufficient oxygen, as in the case of air atmosphere tested in this example, it substantially precludes welding of particles of metallic powder to other such particles. Since generally, the less reactive the milling atmosphere, the greater the tendency for particles to agglomerate by welding. The milling atmosphere should be preferably an inert atmosphere to enhance welding of particles.

EXAMPLE 2

Agglomeration and Consolidation of Composite Materials

Figure 10A:
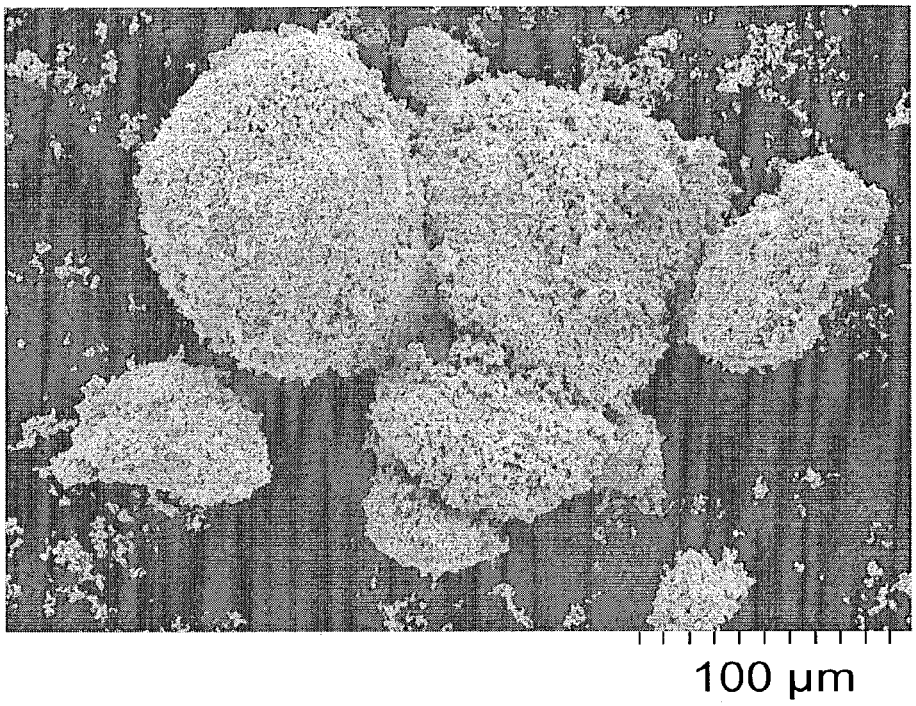
FIG. 10*a*) and 10*b*) are enlarged scanning electron microscope images of the powder for materials 1 (350×) and 2 (50×) (top-corner image at 350×), respectively, as described in Table 1.
Figure 10B:
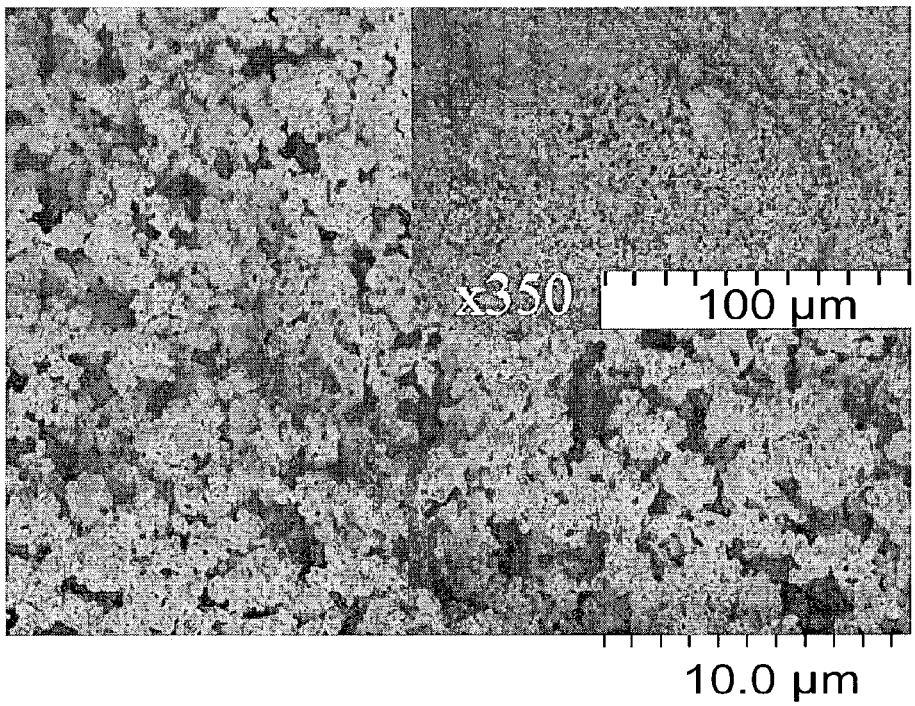
Figure 11:
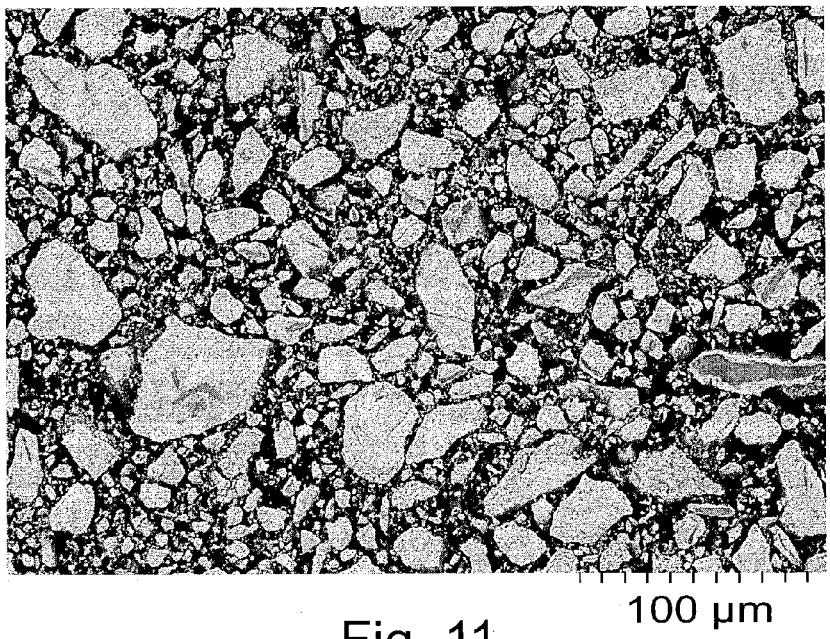
FIG. 11 is a scanning electron microscope cross-section image at detailed enlargement (350×) of powder for material 8.

The process disclosed herein can also be used to fabricate mixtures of ductile and fragile materials. FIG. 10*a* and 10*b* are SEM depicting the starting original mixture materials 1 and 2 (i.e. nano-sized particles of copper and WC carbide, respectively), as described in Table 1. The manufacturer specified that the carbide particle size in material 2 is less than about 1 μm. By using the process disclosed herein, it was possible to agglomerate the mixture into particles of a size ranging from about a few μm to about 100 μm, as shown in FIG. 11. This cross section image attests that the resultant powder has high density. Those skilled in the art will realize that changes in parameters such as ball milling energy and time duration of milling may be optimized to obtain adequate adjustment regarding the density and size of particles.

EXAMPLE 3

Densification and Consolidation of Commercially Agglomerated Nanostructured Materials According to the invention, cermet powders (WC-12wt. % Co), represented by material 3 in Table 1 was ball milled for 1 h under an air atmosphere to fabricate material 9.

Figure 12A:
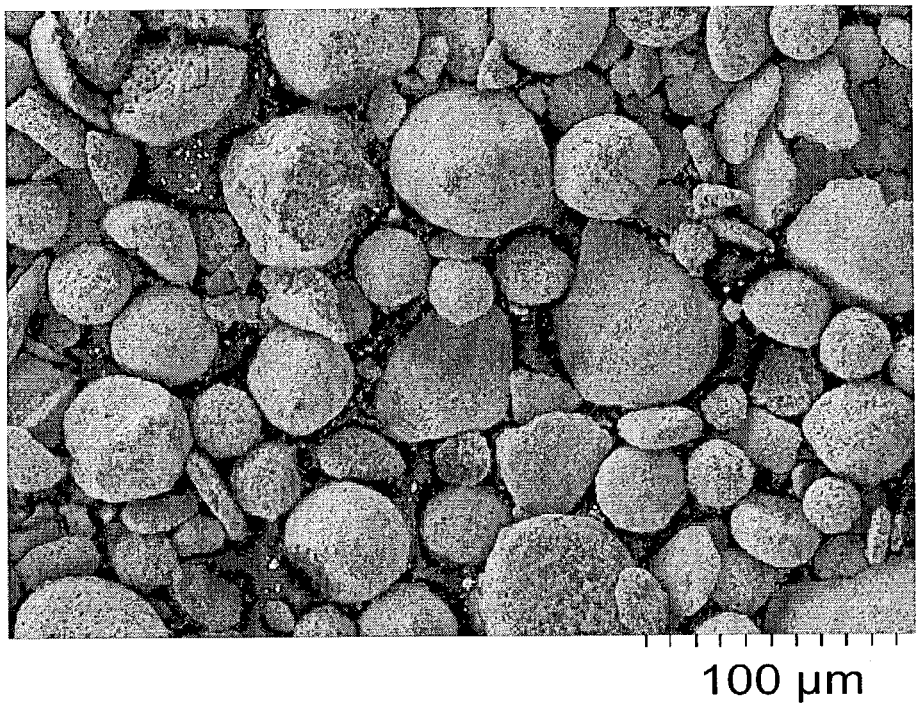
FIGS. 12*a*) and 12*b*) are enlarged scanning electron microscope images (350× and 20000×, respectively) illustrating the morphologies of the powders, corresponding to material 3 as described in Table 1.
Figure 12B:
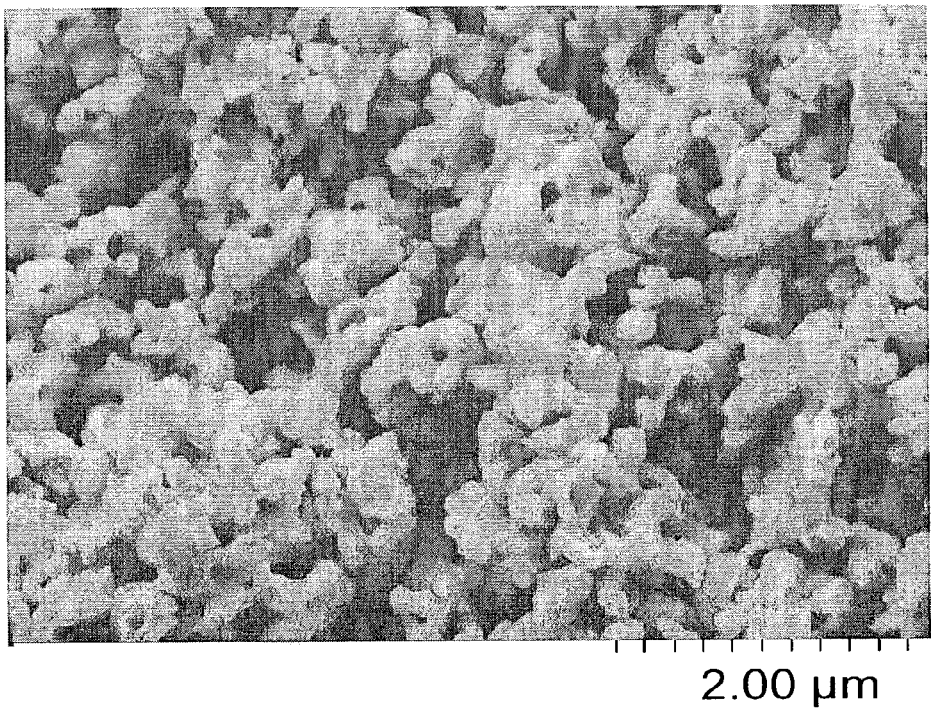

The initial powder of material 3 is illustrated in FIGS. 12*a* and 12*b*. It has a nominal composition of 88 wt. % WC and 12 wt. % Co and exhibits a structure with nanosized fine carbide bound by metallic cobalt and a spherical highly porous powder morphology. This is consistent with the type of particle shape produced by a spray-drying process. As specified by the manufacturer, the powder has an agglomerate size range of 38–106 μm with WC grain sizes of 50 nm and less.

Figure 13A:
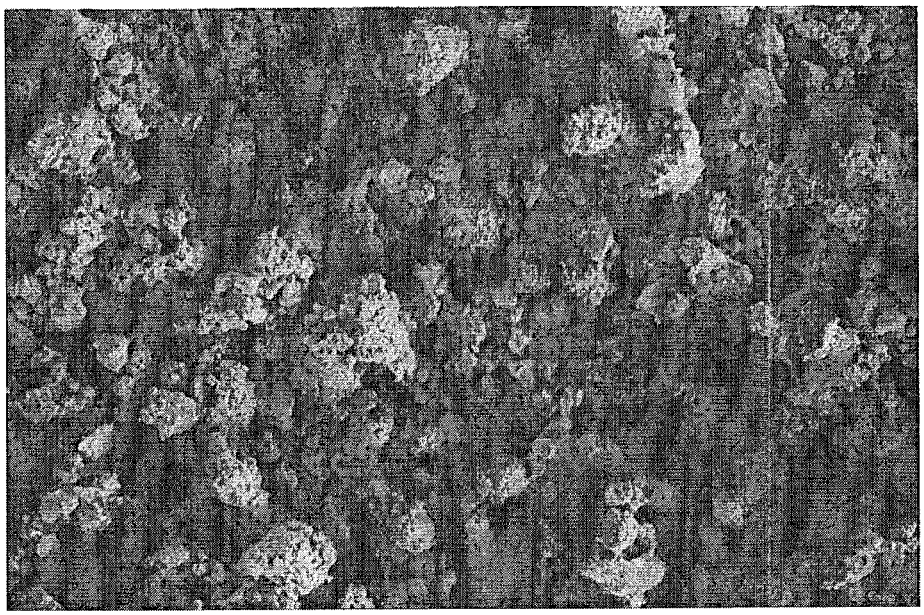
FIGS. 13*a*) and 13*b*) are enlarged scanning electron microscope cross-section images at 350× fo the powder for material 9 of Table 1.
Figure 13B:
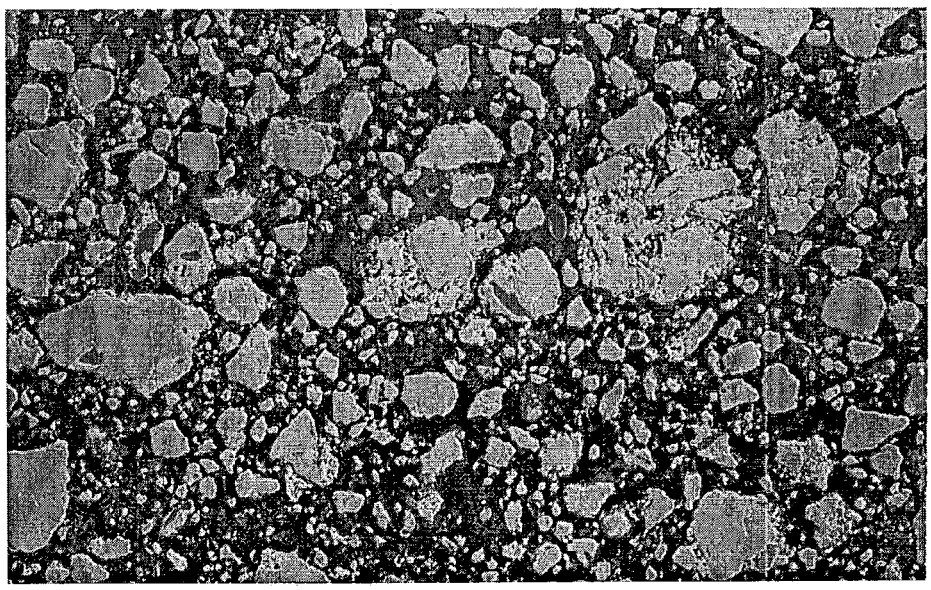

FIG. 13*a* is an SEM image of material 9, ball milled for 1 h under air. The particle size ranges from about a few micrometers to about more than 50 μm. This is a particle size distribution slightly different from the original starting material 3. On the other hand, as evinced by the cross section image of powder illustrated in FIG. 13*b*, the new produced material has particles with a higher density than the original. Thus, by applying the process of the present invention to densification of the starting material was possible to thus avoid processing the consolidation by other process like the cold compaction or sintering.

TABLE 2

Crystallite size calculated from the X-ray diffractions patterns

| Material | Copper Crystallite Size (nm) |
|---|---|
| 1 | 44 |
| 5 | 14 |
| 7 | 15 |

Figure 14:
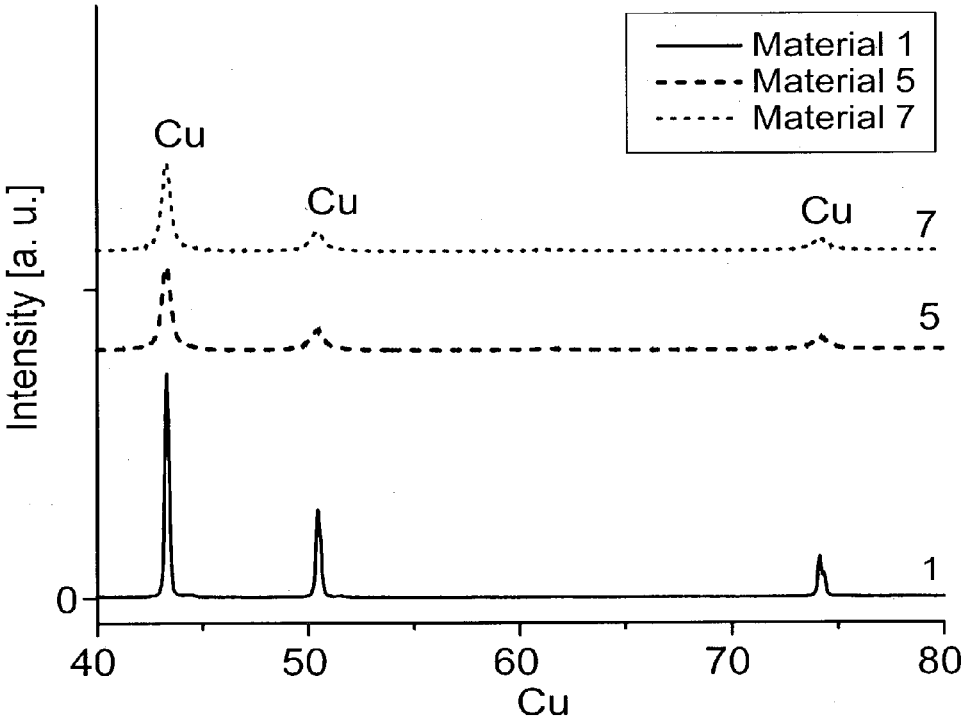
FIG. 14 illustrates the X-ray diffraction patterns, made by ball milling powders, corresponding to materials 1, 5 and 7, of Table 1.

The grain size in the agglomerated particles following the application of the process herein described did not increase. This is supported by the data of which Table 2 presents the crystallite size calculated from the X-ray diffraction patterns presented in FIGS. 14 and corresponding to materials 1, 5, and 7. It indicates that no grain growth occurred after the milling process of the starting nanosized particles. Advantageously, the process disclosed herein was found to not alter the nanostructure state of the original materials.

The embodiment(s) of the invention described above is(are) intended to be exemplary only. The scope of the invention is therefore intended to be limited solely by the scope of the appended claims.

We claim:

1. A method of increasing the density of nanoparticles, consisting essentially of:

providing particles of a nanometer size; and agglomerating said nanoparticles by ball milling to consolidate said nanoparticles into agglomerated particles having a micrometric size distribution in the absence of binder material and while retaining said nanoparticles within said agglomerated particles within the nanometric size, said method being conducted in an inert atmosphere.

2. The method as set forth in claim 1, further including the step of forming said nanoparticles.

3. The method as set forth in claim 1, wherein said method is conducted under a nitrogen atmosphere.

4. The method as set forth in claim 1, wherein said agglomerated particles comprise agglomerated nanometric grains.

5. The method as set forth in claim 1. wherein said nanoparticles comprise metallic particles.

6. The method as set forth in claim 1, wherein said nanoparticles comprise composite material particles.

* * * * *